United States Patent [19]

Roberts

[11] 4,123,824

[45] Nov. 7, 1978

[54] TIE TACKS

[76] Inventor: Herbert B. Roberts, 219 Glen Cove Dr., Chesterfield, Mo. 63017

[21] Appl. No.: 795,157

[22] Filed: May 9, 1977

[51] Int. Cl.[2] ..... A41D 25/04

[52] U.S. Cl. ..... 24/49 CP; 151/38

[58] Field of Search ..... 24/49 R, 49 CF, 49 KC, 24/49 K, 49 M, 49 CP, 49 CC, 49 S, 49 A, 49 C, 155 R; 85/50 R; 151/38

[56] References Cited

U.S. PATENT DOCUMENTS

| | | | |
|---|---|---|---|
| 2,621,386 | 12/1952 | Bowder | 24/49 CP |
| 2,761,349 | 9/1956 | Heller | 151/38 |
| 2,930,424 | 3/1960 | Buren | 151/38 |
| 3,829,936 | 8/1974 | Schuchman | 24/49 P |

*Primary Examiner*—Henry Jaudon

*Attorney, Agent, or Firm*—Haverstock, Garrett and Roberts

[57] ABSTRACT

A tie tack characterized by a surface adapted to be in contact with a tie covered at least in part with a depressible material adapted to prevent rotation when the tie tack is in service.

1 Claim, 3 Drawing Figures

TIE TACKS

BACKGROUND OF THE INVENTION

Tie tacks are well known and universally used to provide restraint for neckties but to allow some movement. Tie tacks range from being relatively uncomplicated and inexpensive to complex structures having expensive gems embedded in the exposed surface. Characteristic tie tacks are disclosed in U.S. Pat. No. 3,449,192 and U.S. Pat. No. 3,357,063.

SUMMARY OF THE INVENTION

Although millions of tie tacks are sold annually throughout the world, many tie tacks display an unfortunate characteristic of rotating when in service. Various devices have been used to prevent rotation. For example, U.S. Pat. No. 3,499,192 discloses and claims a mechanical method for preventing rotation. It is also known to incorporate supplemental prongs on the inward facing surface of the outer portion of the tie tack to engage the necktie and prevent rotation. Unfortunately, many such devices are difficult to use and many tend to snag the fabric of the tie.

This invention relates to the use of a depressible material on either the inner surface of the outer portion of the tie tack or the outer portion of the inner surface of the tie tack which prevents rotation of the tie tack when the two portions are mated together in a tie holding position.

DESCRIPTION OF THE PREFERRED EMBODIMENTS

The preferred embodiment of this invention is a tie tack wherein at least one surface adapted to be in contact with a tie is covered at least in part with a layer of non-staining depressible foam material, said layer of depressible foam material being thick enough to engage the tie when in service to prevent rotation of exposed parts of a tie tack and thin enough to avoid interference with the normal functioning of the tie tack.

The invention can be best understood by reference to the drawing wherein.

Figure 1:
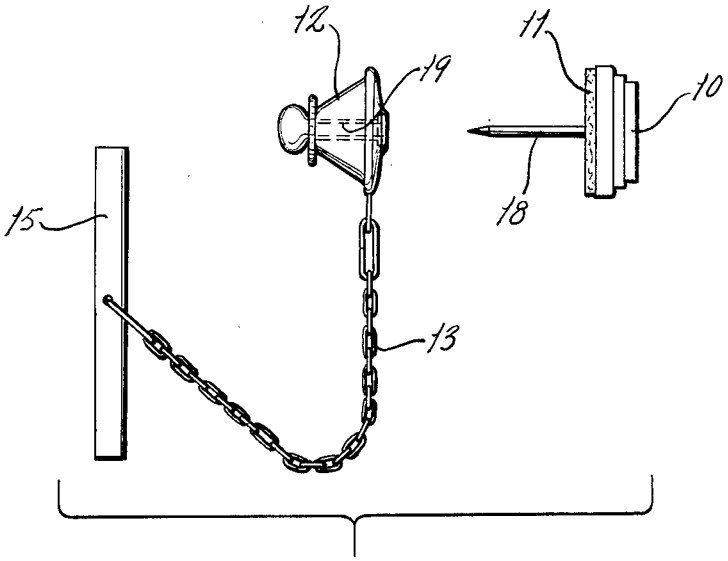
FIG. 1 shows a tie tack wherein the outer member is covered on the inner surface with a depressible foam material.
Figure 2:
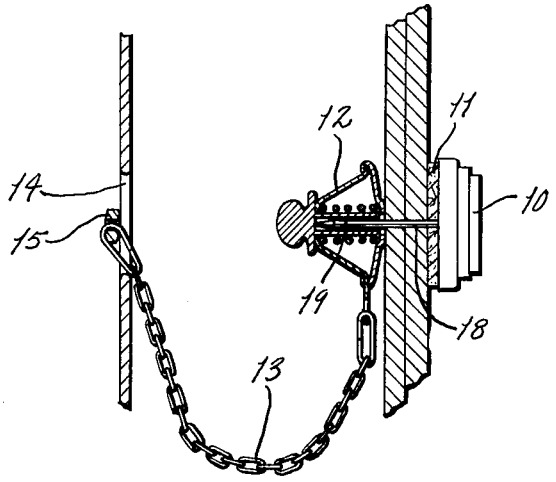
FIG. 2 shows the tie tack of FIG. 1 in cross-section about a tie.

Referring to the drawings, the outer member 10 is covered on the inner surface with a depressible foam material 11. The inner member of the tie tack 12 is shown in FIG. 1 removed from the outer portion of the tie tack and, in FIG. 2, in mating relationship with the outer portion of the tie tacl. The chain 13 is adapted to pass through the buttonhole 14 and to hold the tie tack and tie in restrained relationship by means of a toggle bar 15.

Figure 3:
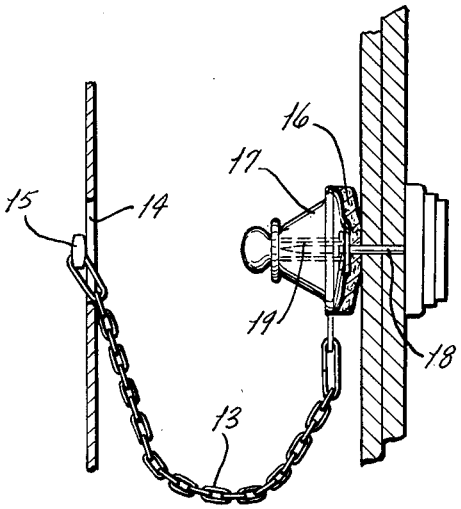
FIG. 3 shows an adaptation of the invention wherein the depressible foam material is on the outer surface of the inner member of the tie tack.

Another embodiment of the invention is shown in FIG. 3 wherein the depressible material 16 is shown on the outer surface of the inner element 17 of the tie tack. The pin 18 is adapted to slidably fit into the opening 19 in order to lock the tie tack assembly together.

Any depressible material can be used in the practice of this invention because it is the frictional relationship between the depressible material and the necktie which prevents rotation of the exposed unit of the assembly. The invention is best utilized with a foamed plastic surface material. Many non-staining foamable plastic materials are well known in the art. All technical libraries have reference works disclosing a broad range of foamed plastic materials having varying compositions and broad ranges of densities. For example, Plastic Foams, Volume 1 Chemistry And Physics of Foam Formations and Volume 2 Structures, Properties and Applications by Calvin J. Benning, published by Wiley — Interscience, a division of John Wiley & Sons, New York, 1969 is an excellant reference. Another book disclosing foamed plastics is the Handbook of Foamed Plastics by Rene J. Bender, Lake Publishing Corporation, Libertyville, Ill., 1965.

Composition of the plastic foam may be almost any non-staining, generally polymeric, material. Examples are polyurethanes, polystyrene, polyvinyl chloride, polyolefins such as polyethylene, polypropylene, polybutylene, etc., foamed depressible phenolic resins, urea-formaldehyde resins, foamed epoxy resins, foamed cellulose acetate, foamed ionomers, foamed depressible nylon and foamed rubbers such as natural rubber, polyisoprene styrene-butadiene and styrene-acrylonitrile-butadiene rubbers. Polyurethanes are particularly preferred for the practice of this invention because they have unique properties that make them adapted to this service. They are non-staining, relatively non-oxidizable, retain their physical and chemical characteristics over long periods of time, and are quite readily available at relatively low cost.

Various densities of foamed material will work in the practice of this invention. Polyethylene ranging in density from 2 to 6 pounds per cubic foot and polyvinyl chloride ranging in density from 6 to 29 pounds per cubic foot are useful in the practice of this invention. Particularly preferred are polyurethane foams which may range in density from 1 to 16 pounds per cubic foot. Very satisfactory results are obtained by using polyurethane foam having a density of 1.2 to 1.7 pounds per cubic foot.

The thickness of the depressible material may range from just thick enough to engage the tie when in service to so thick that it barely avoids interference with the normal functioning of the tie tack. Generally, the layer of depressible foam material will be relatively thin, for example, about one thirty second inch or less thick to about one eighth inch or more thick. Particularly good results can be achieved with a layer of polyurethane foam having a density of about 1.6 or 1.7 pounds per cubic foot and a thickness of about one sixteenth inch.

The layer of depressible materials may be attached to the tie abutting surface of the tie tack in any conventional manner. For example, a layer of depressible foamable plastic material may be spray coated onto the surface where it self-adheres when it cures. The invention is also adapted to adhesively attaching previously prepared thin layers of depressible plastic foam materials because they are readily available on the market. Any well known adhesive can be used. For example, epoxy adhesives, urea-formaldehydes adhesives, urethane adhesives etc. A particular useful adhesive is a polyurethane adhesive which can be coated with a stripable surface material such as paper, cellulose acetate, polyethylene or any other well known strippable material.

The foregoing specification sets forth a preferred embodiment of my invention. However, it will be understood that any other adaptations of this invention are intended to be in the scope of this invention as set forth in the following claims.

What is claimed is:

1. A tie tack wherein at least one surface adapted to be in contact with a tie is covered at least in part with a layer of non-staining depressible polymeric plastic polyurethane foam material, said layer of depressible polymeric plastic polyurethane foam material ranging in thickness from about 1/32 inch to about ⅛ inch, thick enough to engage the tie when in service to prevent rotation of exposed parts of a tie tack and thin enough to avoid interference with the normal functioning of the tie tack.

* * * * *